United States Patent [19]

Peterson

[11] Patent Number: 4,531,590

[45] Date of Patent: Jul. 30, 1985

[54] FLUID PRESSURE ACTUATED PERFORATING GUN

[75] Inventor: Elmer R. Peterson, Houston, Tex.

[73] Assignee: Baker Oil Tools, Inc., Orange, Calif.

[21] Appl. No.: 593,364

[22] Filed: Mar. 26, 1984

[51] Int. Cl.[3] ..... E21B 43/112

[52] U.S. Cl. ..... 175/4.52; 175/4.56

[58] Field of Search ..... 175/4.52, 4.54–4.55, 175/4.57, 4.58, 4.56; 102/322, 275.11

[56] References Cited

U.S. PATENT DOCUMENTS 3,189,094 6/1965 Hyde ..... 175/4.52

4,194,577 3/1980 Vann ..... 175/4.52

FOREIGN PATENT DOCUMENTS 0092476 10/1983 European Pat. Off. .

*Primary Examiner*—Stephen J. Novosad

*Assistant Examiner*—Thuy M. Bui

*Attorney, Agent, or Firm*—Norvell & Associates

[57] ABSTRACT

A well perforating gun assembly includes a perforating gun secured to the bottom of a tubular actuating housing containing a fluid pressure actuated hammer and a fixedly mounted primer against which the firing means is impacted. A latch normally maintains the firing means in an elevated position with respect to the primer but such latch may be released through the application of sufficient fluid pressure force to the firing means to drive it into engagement with the primer. If the primer fails to ignite, a second fluid pressure force is employed to move the firing means to its original latched position, ready for a second application of fluid pressure to release the firing means and again impact the primer.

16 Claims, 9 Drawing Figures

FLUID PRESSURE ACTUATED PERFORATING GUN

BACKGROUND OF THE INVENTION

1. Field of the Invention

This invention relates to a gun for effecting the perforation of the casing and adjacent formation of a well, and particularly to a perforating gun wherein the firing of the gun is accomplished through the utilization of fluid pressure forces.

2. Description of the Prior Art

Perforating guns have long been employed to effect the perforation of a well casing in the vicinity of a production zone and to produce fractures extending into such production zone. The popular perforating guns now uniformly employ the so-called "shaped charges", which are disposed in vertically and angularly spaced relationship relative to the casing axis so as to produce a large number of evenly spaced perforations with a single firing. Such shaped charges are generally ignited by a primacord which contacts a primer end of each shaped charge container to ignite a primer contained within each such container.

The ignition of the primacord is commonly accomplished by either electronically actuating a detonator or by dropping a weight or bar on an impact actuated primer or detonator which is stationarily positioned immediately above the perforating gun housing and is connected to the primacord which extends downwardly through the perforating gun housing. The employment of a detonating bar dropped through a tubular conduit as a means for effecting the ignition and discharge of the perforating gun has encountered difficulties in those wells wherein the well bore deviates substantially from the true vertical when passing through a particular production zone. The deviation may be sufficiently great so that the fall speed of the detonating bar is substantially reduced to the point that insufficient impact energy is imparted to the primer to effect its discharge. In other wells where it is neccessary to employ a high density kill fluid or the like, the existence of such fluid in the conduit bore through which the detonating bar is dropped can very well reduce the speed of the detonating bar to an ineffective level. Such failures to detonate the primer obviously imposes a substantial cost and time penalty on the completion of the well, since the detonating bar must be engaged by a fishing tool, pulled back up to a high level in the well and again dropped to hopefully effect the ignition of the primer on the next try. The hydraulic firing head will also be useful in heavy mud situations where particulates deposit on a mechanical firing head which can reduce bar impact.

SUMMARY OF THE INVENTION

The invention provides a perforating gun assembly comprising a work string having a perforating gun mounted at the end thereof, a fluid pressure actuated firing means (such as a hammer) mounted in a housing above the perforating gun, a crossover tool mounted above the hammer housing for effecting proper direction of fluid pressure to opposite ends of the hammer, and a conventional packer, which is utilized to position the aforementioned assembly in a selected region of the well casing where the perforation is to be accomplished. The fluid pressure actuated hammer unit comprises a primer fixedly mounted within the tubular housing and having appropriate contact with a primacord extending downwardly through the perforating gun to the various shaped charges mounted therein.

The actuator housing defines a cylindrical bore within which a hammer is slidably and sealably mounted for reciprocating vertical movements. The hammer is normally latched in an elevated position with respect to the primer by, for example, a collet, and a substantial fluid pressure force must be exerted on the upper end of the hammer in order to effect the unlatching of the collet and subsequent downward movement of the hammer and firing pin into impact engagement with the primer. Such latching force is selected to insure that when the hammer is released by the latch, it will have sufficient energy to normally effect the discharge of the primer in the first stroke of the hammer. In the event, however, that the first stroke of the hammer does not discharge the primer, the crossover tool provides means for directing fluid pressure supplied from the well head to the bottom portion of the cylindrical bore and thus be effective to return the hammer to its elevated position. Thus, two or more successive actuations of the hammer by fluid pressure applied from the well head may be effected until the primer is discharged.

A further feature of the invention is that the existence of a fluid pressure differential between the internal conduit fluid pressure at the level of the actuator and the casing annulus fluid pressure may be utilized to effect the release of the hammer and the driving of it downwardly into impact engagement with the primer.

Further advantages of the invention will be readily apparent to those skilled in the art from the following detailed description, taken in conjunction with the annexed sheets of drawings, on which is shown a preferred embodiment of the invention.

DESCRIPTION OF THE PREFERRED EMBODIMENTS

A perforating gun assembly is shown in FIGS. 1A, 1B, 1C and 1D mounted in a well casing 1. The assembly comprises a conventional sealing device, or packer 2 which may be of either the fluid pressure or mechanically actuated type, and is conventionally connected to a tubular work string 3 by an upper sub 4. Packer 2 is schematically illustrated in its set position within the well casing 1.

Figure 1A:
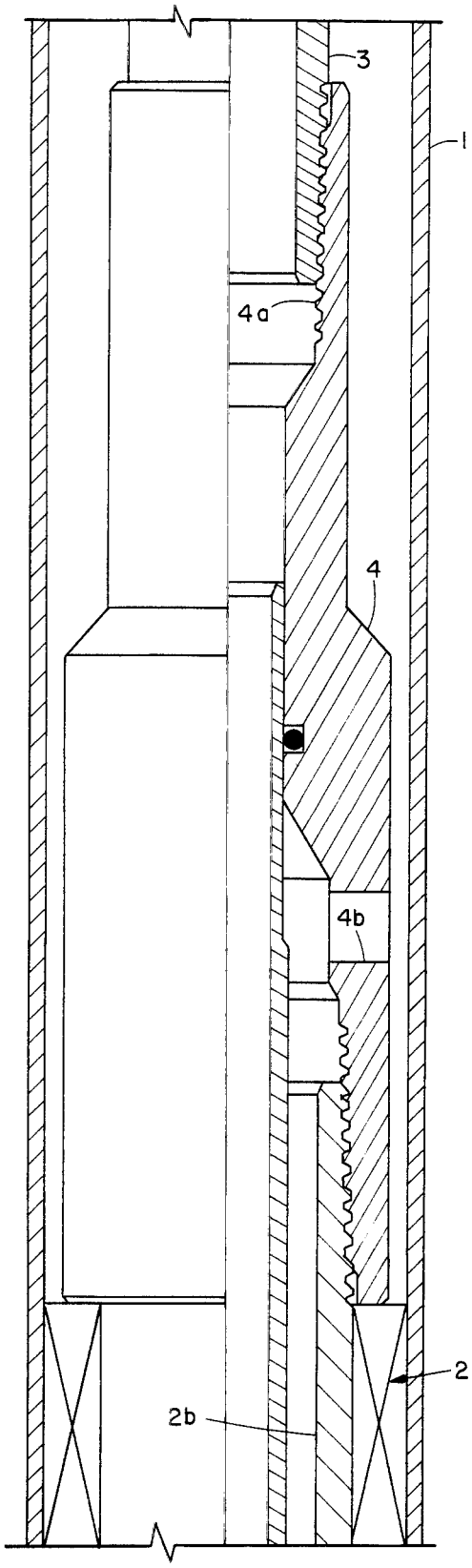
FIGS. 1A, 1B, 1C and 1D collectively represent a vertical sectional, schematic view of an impact actuated perforating gun assembly embodying this invention, FIGS. 1B, 1C and 1D being respectively vertical continuations of FIGS. 1A, 1B and 1C, and illustrating the position of the components in their run-in, prefiring position.
Figure 2A:
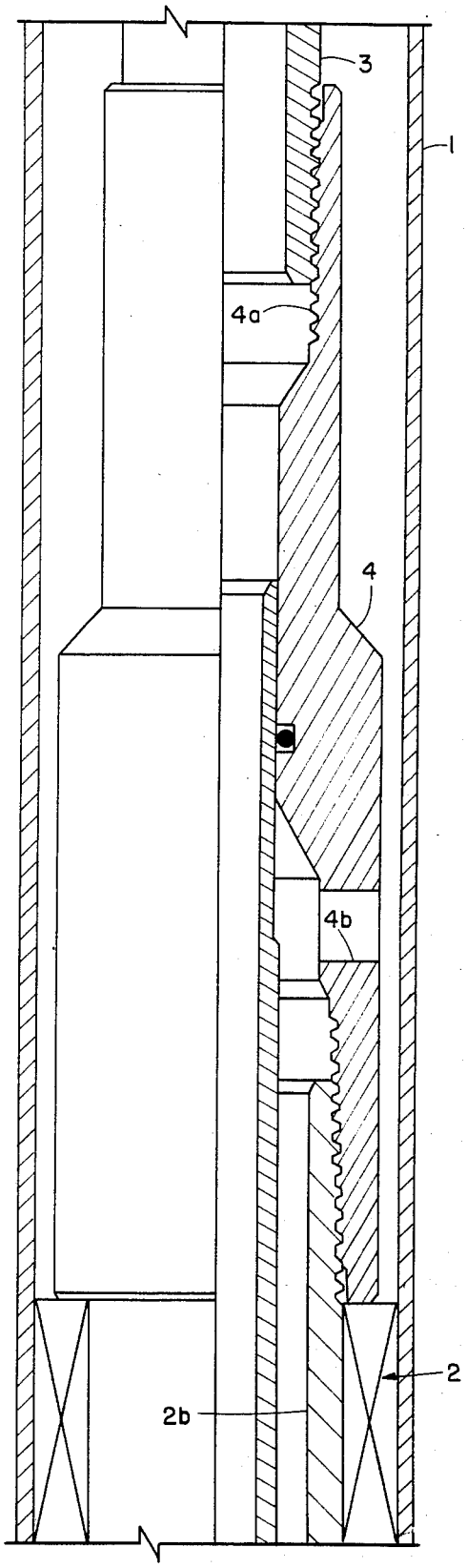
FIGS. 2A, 2B, 2C and 2D are views respectively corresponding to FIGS. 1A, 1B, 1C and 1D, and illustrating the position of the components after the release of the hammer to move to its firing position.
Figure 1B:
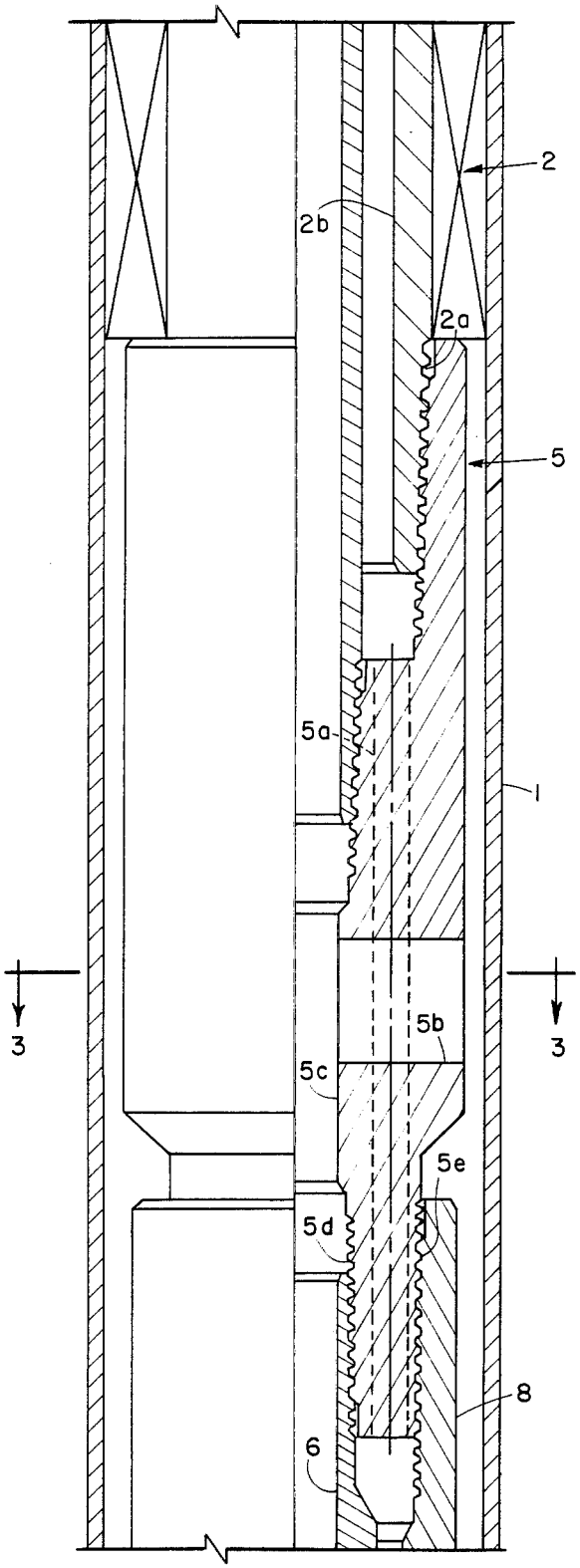
Figure 1C:
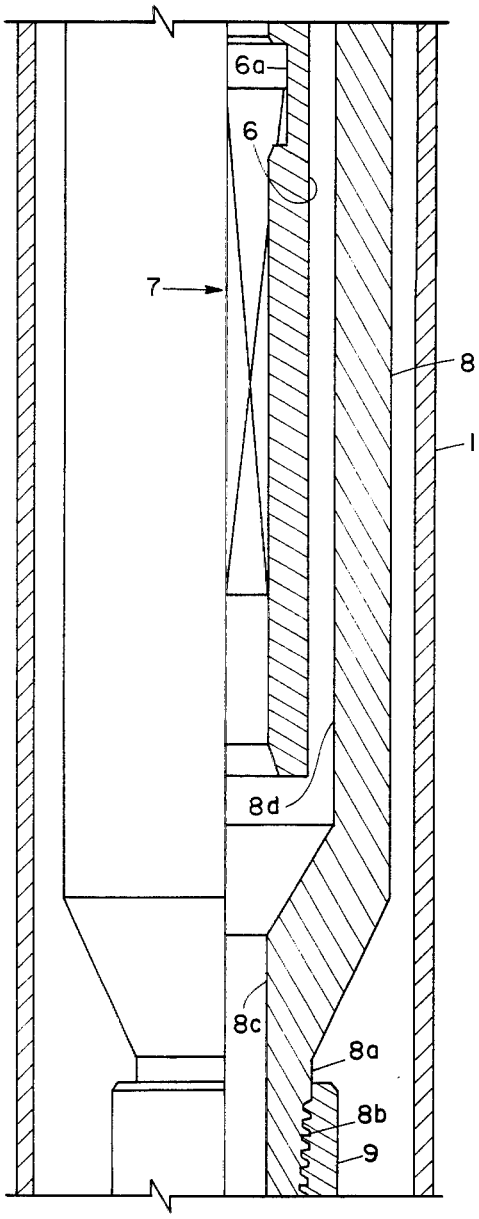
Figure 1D:
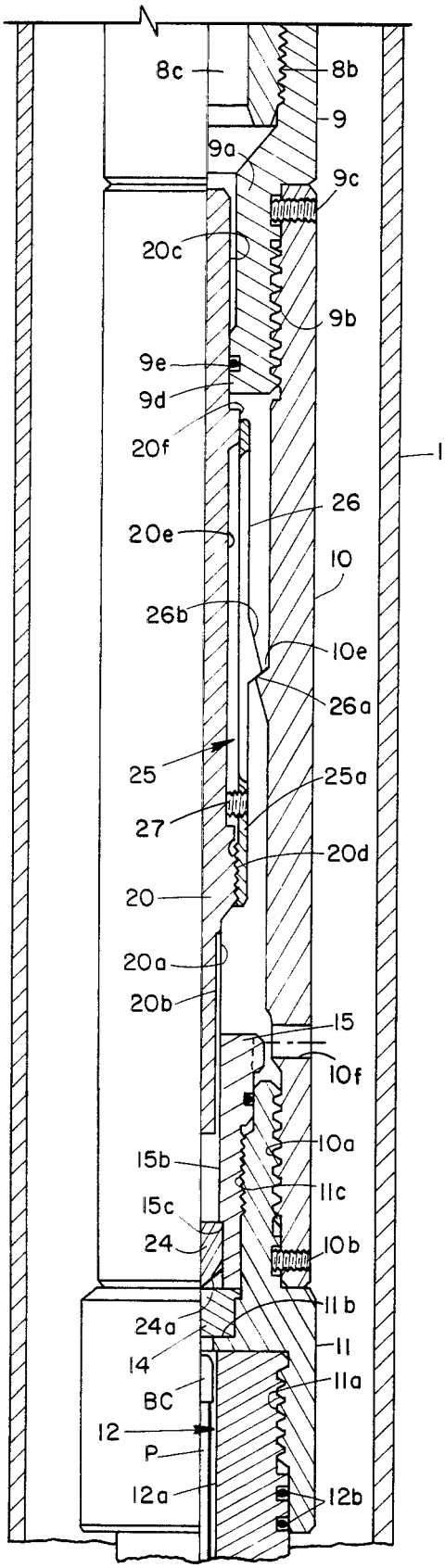
Figure 3:
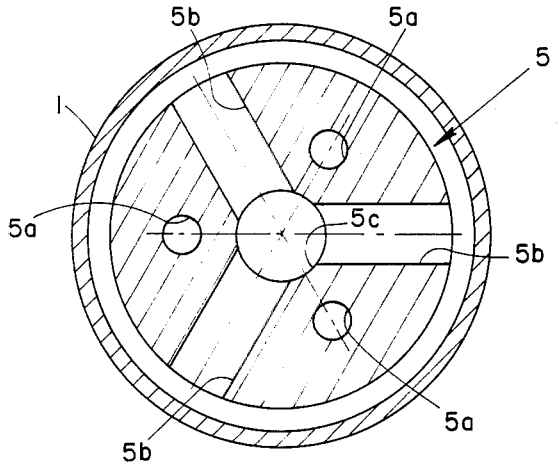
FIG. 3 is a sectional view taken on the plane 3—3 of FIG. 1B.

A hollow crossover tool 5 is connected to the lower portions of the body of packer 2 by threads 2*a*. As best shown in FIGS. 1B and 3, crossover tool 5 defines a plurality of peripherally spaced, vertically extending fluid passages 5*a* which respectively communicate with vertically extending passages 2b provided in the body of packer 2 and connect with the casing annulus through a radial port 4b provided in the upper sub 4. Additionally, the crossover tool 5 is provided with a plurality of radially directed ports 5b which provide fluid communication between the bore 5c of the crossover tool 5 and the casing annulus below the packer 2.

The lower portion of annular crossover tool 5 is provided with both external and internal threads 5d and 5e. The internal threads 5d provide a mounting for a downwardly extending sleeve 6 which in turn is provided with an annular recess 6a for the temporary mounting therein of a conventional blanking plug 7, which is only indicated schematically. Blanking plug 7 is of any type conventionally available to effect the temporary closing of the central bore 5c of the crossover tool 5. The external threads 5e provide a mounting for the top portion of a reduction sub 8 which has a reduced diameter lower end 8a provided with external threads 8b. A second reduction sub 9 is secured to threads 8b and is provided at its lower reduced end 9a with external threads 9b for mounting thereon of a firing means, such as tubular hammer housing 10. A set screw 9c effects the securement of threads 9b.

The tubular hammer housing 10 is in turn provided with internal threads 10a at its lower end which are threadably engaged to the upper portion of an expander connecting sub 11. The threaded connection is secured by a set screw 10b. The expander sub 11 is internally threaded, as indicated at 11a, to engage external threads provided on the top of a perforating gun 12. Gun 12 may be of any one of the perforating guns currently available on the market but preferably comprises a gun constructed in accordance with the disclosure of copending patent application Ser. No. 527,183, filed Aug. 29, 1983 and assigned to the Assignee of the instant application. The gun 12 has a constricted bore 12a extending through its upper portions and a booster charge BC and primer cord P are mounted in the bore 12a in conventional fashion. O-ring seals 12b effect the sealing of threads 11a.

The interior of the expander sub 11 is configured to provide a mounting for a conventional detonator or primer 14 which is fixedly supported within the expander sub 11 by an upwardly facing shoulder 11b. Additionally, a sleeve 15 defines an internal bore 15b which slidably mounts an external cylindrical surface 20a of an elongated hammer or detonating rod 20. Beneath the hammer 20, a firing pin 24 is mounted in a counter bore 15c provided in the bottom end of the hammer support sleeve 15. Firing pin 24 is provided with a pointed end 24a for penetrating the primer or detonator unit 14. To avoid trapping fluid between the bottom end of hammer 20 and the firing pin 24, the hammer is provided with one or more axially extending grooves 20b to permit the trapped fluid to freely bypass the descending hammer.

Hammer 20 is supported at its upper end for axial sliding movements by an internal shoulder 9d provided on the reduction sub 9. An O-ring seal 9e effects sealing connection with the adjacent cylindrical surface 20c of the hammer 20.

On a medial portion of hammer 20, a latching collet 25 is mounted as by having a ring portion 25a threadably secured to external threads 20d formed on the hammer 20.

The collet 25 has a plurality of peripherally spaced, axially extending arms 26 which are supported at their upper end by an outwardly projecting shoulder 20f formed on the hammer 20. A downwardly, inwardly inclined abutment surface 26a is provided on the medial portion of each collet arm 26 and engages an upwardly facing corresponding internal surface 10e formed on the hammer housing 10. A set screw 27 engages an external surface 20e provided on hammer 20 to secure the threads 20d. The angle of engagement between the surfaces 26a and 10e are coordinated with the resilience of collet arms 26 to permit the hammer and the attached collet arm to be forced downwardly past the shoulder 10e upon the application to the hammer 20 of a force deemed more than adequate to effect the discharge of the primer 14.

Figure 2B:
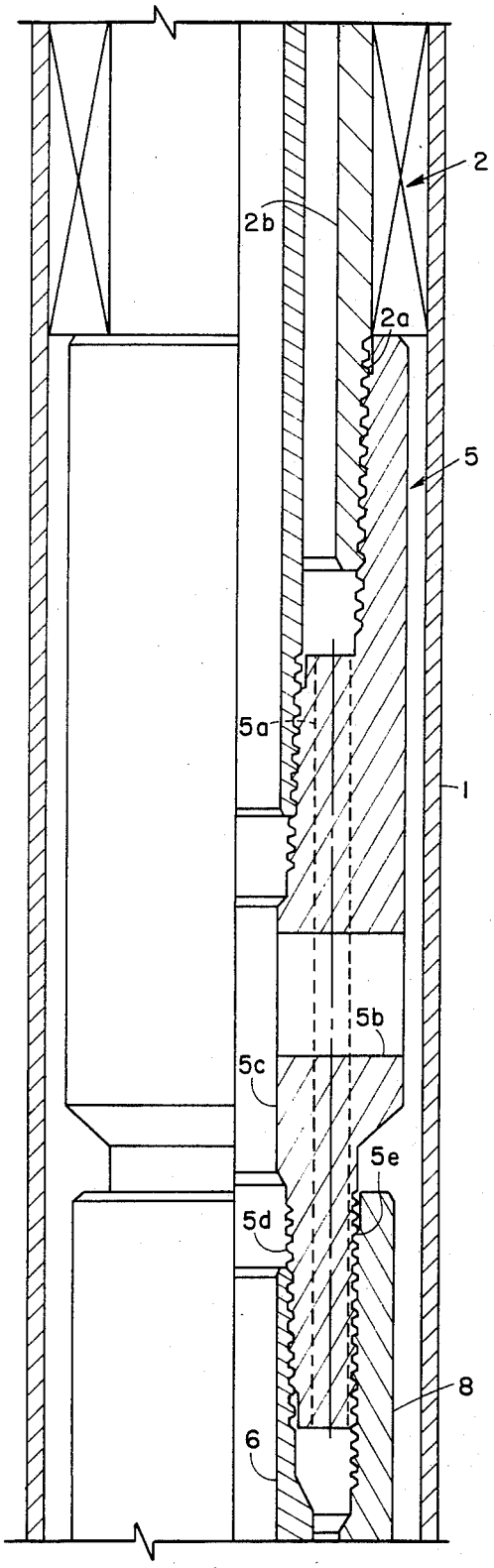
Figure 2C:
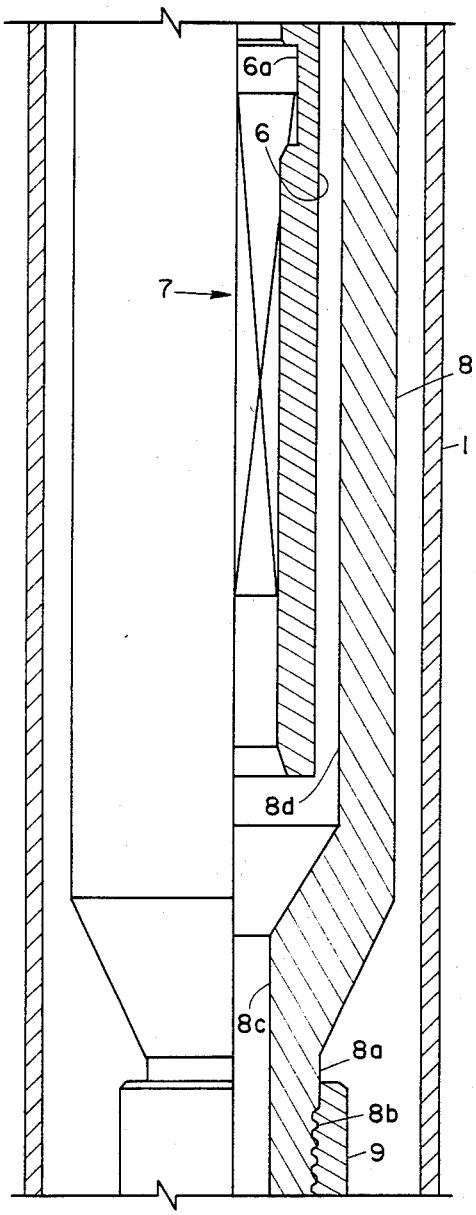
Figure 2D:
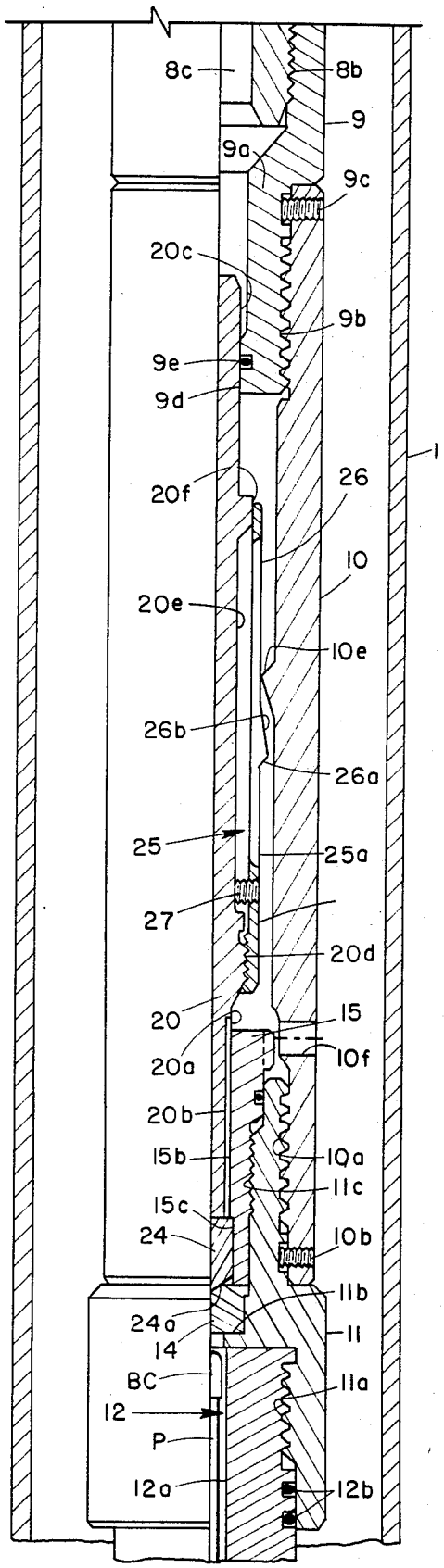

Such force is applied by fluid pressure applied to the upper end of hammer 20 which, by virtue of the O-ring seal 9e, functions as a piston. Such fluid pressure is applied through the bore 8c of the reduction sub 8, which is in communication with the annulus 8d defined between the interior bore of the reduction sub 8 and the exterior surface of the blanking plug mounting sleeve 6. As previously mentioned, this annulus 8d is in fluid communication with the vertically extending passages 5a provided in the crossover tool 5 and thus communicates with the casing annulus above the packer 2. It is therefore apparent that any fluid pressure applied to the casing annulus would be imparted to the upper end of the hammer-piston 20 and exerts a downward force on the hammer 20 sufficient to dislodge the collet arms 26 from the abutment shoulder 10e and permit the hammer 20 to drive downwardly to impact the firing pin 24 (FIG. 2*d*) and thus effect the detonation of the primer 14.

It should be noted that the establishment of a fluid pressure differential below the packer between the casing annulus and the region below hammer 20 will also release the hammer due to the provision of a radial port 10f in hammer housing 10.

In the event that for any reason, the impact force produced by the release of hammer 20 is insufficient to produce detonation of primer 14, the construction of this invention permits the hammer to be retracted to its original elevated position and released again. Such retraction is produced by releasing the fluid pressure from the casing annulus and applying a fluid pressure to the bore of the tubular work string 3. Such fluid pressure passes downwardly into the bore 5c of the crossover tool 5. It cannot pass through the bore 5c due to the provision of the temporary blanking plug 7. It therefore flows outwardly through the radial ports 5b and into the annulus between the crossover tool 5 and the casing 2, but at a point below the set packer 2. The fluid flow down the lower casing annulus flows through the radial port 10f provided in the wall of the hammer housing 10 and impinges upon the bottom portions of the hammer 20, thus exerting an upward force sufficient to move the hammer to its elevated position shown in FIG. 1D wherein the collet arms 26 are again engaged with the latching surface 10e. For this purpose, an upwardly facing inclined surface 26b is provided on the collet arms immediately above the latching surface 26a, thus permitting the upward movement of the hammer 20 to be accomplished with the exertion of less fluid pressure force than the downward movement.

The fluid pressure in the work string 3 is released after the re-setting of the hammer 20 in its elevated position, and the hammer is again forced downwardly through the application of fluid pressure to the casing annulus above the packer 2. Thus, the hammer may be caused to repeatedly impact the firing pin 24 on the primer 14 and, it will eventually be discharged by the successive blows received from the hammer 20. As a last resort, the blanking plug 7 may be removed by wireline and a detonating bar dropped on hammer 20. Thus the firing of the perforating gun may be accomplished with a high degree of assurance that only a single trip of the perforating apparatus into the well will be required.

Although the invention has been described in terms of specified embodiments which are set forth in detail, it should be understood that this is by illustration only and that the invention is not necessarily limited thereto, since alternative embodiments will become apparent to those skilled in the art in view of the disclosure. Accordingly, modifications are contemplated which can be made without departing from the spirit of the described invention. What is claimed and desired to be secured by Letters Patents is:

1. An actuator for a well perforating gun having a primer ignitable by the application of impact energy reaching a predetermined amount, comprising: a housing fixedly supporting the primer; a firing means axially shiftably mounted in said housing above said primer, whereby downward movement of said firing means transfers impact energy to said primer; radially shiftable, resiliently biased means for securing said firing means in a elevated position relative to said primer; said securing means being responsive to a predetermined downward force to shift radially against said resilient bias to release said firing means; said fluid pressure responsive means for exerting sufficient downward force on said firing means to release same from said securing means and drive said firing means into said primer.

2. The apparatus of claim 1 wherein said predetermined downward force is selected to normally cause impact ignition of said primer upon a single movement of said firing means.

3. The actuator of claim 1 wherein said securing means comprises an upwardly facing, downwardly inclined annular latching surface on the interior of said housing; said firing means comprises a collet secured to a hammer and having a plurality of peripherally spaced, axially extending, resilient arm portions; said arm portions each having a downwardly facing abutment surface cooperable with said annular latching surface to hold said hammer in said elevated position.

4. An actuator for a perforating gun disposed in a subterranean well below the surface, said perforating gun having a primer ignitable by the application of impact energy reaching a predetermined total, comprising: a housing fixedly supporting the primer; a firing means axially shiftably mounted in said housing above said primer, whereby, downward movment of said firing means transfers impact energy to said primer; resiliently biased securing means for securing said firing means in an elevated position relative to said primer, said securing means being responsive to a predetermined downward force to release said firing means; said housing defining a cylindrical bore above said primer; a cylindrical surface on said firing means slidably and sealably cooperating with said cylindrical bore; and conduit means for sequentially supplying fluid pressure from the surface to the upper and lower ends of said cylindrical bore to release said firing means from said securing means and drive said firing means into the primer, and then to move said firing means upwardly to return to said elevated position.

5. The actuator of claim 4 wherein said conduit means includes a tubular string defining a first internal bore conduit and a second casing annulus conduit, and crossover means for directing fluid pressure from one of said conduits to impinge on one end of said firing means to move said firing means past said securing means toward said primer, and for directing fluid pressure from the other of said conduits to impinge on the other end of said firing means to move same upwardly to return to said elevated position, whereby said firing means may be successively impacted on said primer to fire said primer by energy transfer.

6. The actuator of claim 3 wherein said securing means comprises an upwardly facing, downwardly inclined annular latching surface on the interior of said housing; said firing means comprises a collet secured to a hammer and having a plurality of peripherally spaced, axially extending, resilient arm portions; said arm portions each having a downwardly facing abutment surface cooperable with said annular latching surface to hold said firing means in said elevated position.

7. The actuator of claim 6 further comprising a downwardly facing outwardly inclined surface below said annular latching surface, and a cooperating upwardly facing camming surfacing on said collet arms to cam said collet arms inwardly upon return upward movement of said firing means to said elevated position.

8. A fluid pressure actuated perforating gun assembly insertable into a well on a tubular conduit comprising: a packer carried by said conduit and settable at a desired location in the well casing; a crossover tool mounted immediate said packer and extending therebelow; a tubular housing secured to the bottom portion of said crossover tool; a perforating gun secured to the bottom portion of said tubular housing; an impact actuated primer fixedly mounted within said housing; a primer cord extending into said perforating gun and ignitable by said primer; a firing means axially shiftably mounted in said housing above said primer, whereby downward movement of said firing means transfers impact energy to said primer; securing means for securing said firing means in a first position relative to said primer; said securing means being responsive to a predetermined force to release said firing means; said housing defining a cylindrical bore above said primer; a cylindrical surface on said firing means slidably and sealingly cooperating with said cylindrical bore; first conduit means in said crossover tool for supplying fluid pressure from the casing annulus above said packer to one end of said cylindrical bore; and second conduit means in said crossover tool for supplying fluid pressure from said tubular conduit to the other end of said cylindrical bore, whereby said firing means may be repeatedly impacted with said primer and retracted to cause firing of said primer by impact energy.

9. The perforating gun assembly of claim 8 further comprising removable plug means for sealing the bore of said crossover tool to prevent direct fluid flow from said tubular conduit into the upper portions of said housing and direct such fluid flow through said crossover tool into the casing annulus below said packer.

10. The method of firing a primer of a well perforating gun by application of impact energy from a firing means vertically shiftably mounted in a cylinder bore by a sealing element comprising the steps of:

(1) securing the firing means in a first position relative to the primer by securing means releasable by the application of a predetermined force to the firing means;

(2) applying fluid pressure to the cylinder bore above the sealing element to produce said predetermined force on the firing means to release same from the releasable means to impact on the primer; and, in the event that the primer is not detonated, (3) returning the firing means to said first position and re-engaging said securing means; and (4) repeating steps (2) and (3) until the firing means detonates the primer.

11. The method of firing a primer of a well perforating gun by application of impact energy from a firing means vertically shiftably mounted in a cylinder bore by a sealing element comprising the steps of:

(1) securing the firing means in a first position relative to the primer by resiliently biased securing means releasable by the application of a predetermined force on the firing means;

(2) applying fluid pressure to the cylinder bore above the sealing element to produce said predetermined force on the firing means to release same from the releasable means to impact on the primer; and, in the event said primer does not detonate, (3) returning the firing means to said first position for re-engagement by said securing means.

12. The method of claim 10 or 11 further comprising the steps of removing said fluid pressure from the cylinder bore if the primer fails to fire; and applying fluid pressure to said cylinder bore below said sealing element to move the firing means upwardly to said first position to re-engage said securing means.

13. The method of claim 10 or 11 further comprising the steps of removing said fluid pressure from the cylinder bore if the primer fails to fire; and applying fluid pressure to said cylinder bore below said sealing element to move the firing means upwardly to said first position to re-engage said securing means; and then repeating step 2 to again effectively impart impact energy to the primer, the fluid pressure force required to return the firing means to said first position being substantially less than the predetermined releasing force.

14. The method of firing a primer of a well perforating gun suspended in a well casing by application of impact energy from a firing means vertically shiftably mounted in the bore of a well conduit by a sealing element, comprising the steps of:

(1) securing the firing means in a first position relative to the primer by means releasable by the application of a predetermined downward force to the firing means;

(2) creating a fluid pressure differential between the well conduit bore pressure and the adjacent casing annulus pressure; and (3) applying said fluid pressure differential to the conduit bore above the sealing element to produce said predetermined force on the firing means to release same from the releasable means to impact on the primer.

15. The method of claim 14 further comprising the steps of removing said fluid pressure from the conduit bore if the primer fails to fire; applying fluid pressure to said conduit bore below said sealing element to return the firing means to said first position and re-secure same in said first position by said releasable means; and then again applying a fluid pressure differential to said conduit bore above the sealing element to again release the firing means and impart impact energy to the primer.

16. The method of claim 15 wherein the fluid pressure force required to return the firing means to said first position is substantially less than said pre-determined releasing force.

* * * * *